US005199583A

United States Patent [19]

Weider et al.

[11] Patent Number: 5,199,583

[45] Date of Patent: Apr. 6, 1993

[54] CRANE TRUCK

[75] Inventors: Wolfgang Weider, Neunkirchen; Hermann Daum, Feucht, both of Fed. Rep. of Germany

[73] Assignee: Faun GmbH, Fed. Rep. of Germany

[21] Appl. No.: 915,427

[22] Filed: Jul. 16, 1992

[30] Foreign Application Priority Data

Jul. 20, 1991 [DE] Fed. Rep. of Germany ..... 4124173

[51] Int. Cl.[5] ..... B66C 23/72

[52] U.S. Cl. ..... 212/156; 212/178; 212/195; 212/231

[58] Field of Search ..... 212/156, 157, 178, 195, 212/231

[56] References Cited

U.S. PATENT DOCUMENTS 3,375,048 3/1968 Korensky et al. ..... 212/178
3,891,095 6/1975 Symmank ..... 212/178

FOREIGN PATENT DOCUMENTS 3912868 8/1990 Fed. Rep. of Germany .

*Primary Examiner*—Joseph F. Peters, Jr.
*Assistant Examiner*—Thomas J. Brahan
*Attorney, Agent, or Firm*—Laff, Whitesel, Conte & Saret

[57] ABSTRACT

The invention relates to a crane truck with a drivable undercarriage and a superstructure supported on the undercarriage to be rotatable by means of a slewing rim, the superstructure having a counterweight, which is movable by an elevating mechanism consisting of two piston-cylinder drives between an elevated operation position and a driving position when it rests lowered onto a support on the undercarriage. The piston rods of the piston-cylinder drives are drivable to rotate between a locking and unlocking position referred to the counterweight. The desired positions of the piston rods in their positions of crane operation and release as well as their locking and unlocking position are displayable by means of proximity switches on the piston-cylinder drives, so as to eliminate operation errors and disturbances in the hydraulic system of the piston-cylinder drives by way of various control units.

13 Claims, 12 Drawing Sheets

CRANE TRUCK

FIELD OF THE INVENTION

The invention relates to a crane truck with a drivable undercarriage and a superstructure supported on the undercarriage to be rotatable by a slewing rim and having a counterweight attached to its counterboom projecting in a direction opposite to the projecting direction of its boom, which counterweight is displaceable between a lifted operation position connected with the counterboom and a driving position when it rests lowered onto a support on the undercarriage by means of a lifting unit.

BACKGROUND OF THE INVENTION

A crane truck is known from DE 39 12 868 C1, the superstructure of which has a counterweight plate on the counterboom for the boom, which is retained on the counterboom of the superstructure for reasons of load compensation and stability during crane operation of the crane truck. During driving operation the counterweight plate is placed on a support on the undercarriage preferably between the driver's cabin of the crane truck and the latter's superstructure, whereby improved load distribution and relief of the slewing rim in attained.

Lowering and lifting of the counterweight plate takes place by means of an elevating mechanism consisting of two vertical hydraulic lift cylinders on the counterboom. The two piston rods of the lift cylinders are drivable to rotate about their longitudinal axis between a locking position non-positively connected with the counterweight plate and an unlocking position released from the counterweight plate. For regular performance of the unlocking rotation the piston rod with its locking element—for instance a transverse bolt at the free end of the piston rod—must be in a so-called piston-rod-release position, in which the non-positive connection between the piston rod and the counterweight plate is released.

With the known crane truck problems may arise regarding the mounting of the counterweight plate to the counterboom by means of the elevating mechanism and regarding the change-over of the crane truck from crane operation into driving operation. For instance, the counterweight plate may come out of its regular crane-operating position during crane operation due to a defect in the hydraulics of the elevating mechanism and move downwards, which cannot or can only hardly be noticed by the crane driver sitting in the driver's cabin on the superstructure during crane operation with his back turned to the counterboom with the counterweight plate. Upon rotation of the superstructure the counterweight plate in its improper lowered position may run against an obstacle, which may cause considerable damage to the crane truck on the one hand and to the obstacle on the other hand. Also the stability of the crane truck during crane operation may be impaired.

SUMMARY OF THE INVENTION

It is an object of the invention to embody a crane truck of the generic kind featuring high reliability in service.

This object is attained by a crane truck comprising a drivable undercarriage, a superstructure supported on said undercarriage to be rotatable by a slewing rim, a counterweight attached to a counterboom of said superstructure, which counterboom projects in a direction opposite to the projecting direction of a boom of said superstructure, a lifting unit comprising of two vertically arranged and hydraulically actuatable piston-cylinder drives on said counterboom, by means of which lifting unit said counterweight is displaceable between a lifted operation position connected with the counterboom and a driving position, in which it rests lowered onto a support on said undercarriage, piston rods of said piston-cylinder drives being drivable to rotate about their longitudinal axis between a locking position non-positively connected with said counterweight and an unlocking position of release from said counterweight, a first sensor responding to the longitudinal movement of said piston rods of each piston-cylinder drive, by means of which first sensor the piston rod position associated with the operation position of the counterweight is detectable, a first display for displaying the piston rod position, a control unit coupled with at least one of the sensor and the display, by means of which control unit a crane control can be switched off, when the counterweight comes out of its operation position, a second sensor equally responding to the longitudinal movement of said piston rods of each piston-cylinder drive, by means of which second sensor the piston-rod-release position to be taken for release of the locking engagement between said piston rods and said counterweight in their drive position is detectable, a second display, by means of which said piston-rod-release position is displayable and a second control unit coupled with at least one of said second sensor and said second display, by means of which a rotary-actuator control of said piston rods can be switched off, when said piston rods are not in their position of release. As a result of the claimed detection and recording of the piston rod position of both piston cylinder drives associated with the crane-operating position of the counterweight by means of the sensor or display, respectively, the crane driver can permanently control the regular position of the counterweight during crane operation. Should the counterweight and thus the piston rods move downwards out of their desired position, this is promptly communicated to the crane driver, who can take the appropriate steps, such as immediately putting into operation the hydraulic drive of the piston-cylinder drives to lift the counterweight up again.

As an additional precaution a control unit is provided, which is coupled to the sensor and/or display. The crane control can be switched off by means of the control unit, should the counterweight have come out of its regular crane operating position. For instance, a rotary movement of the superstructure is thus interrupted, as a result of which the latter cannot run against an obstacle with the lowered counterweight.

The further provided detection and display of the piston-rod-release position serve to communicate to the crane driver that the counterweight is in its regular position placed on the undercarriage and that the locking engagement between the locking elements of the piston rods and the counterweight is relieved. In this condition the rotary actuator of the piston rods can be actuated to disengage their locking connection with the counterweight. By means of the additionally provided second control unit the rotary actuator control of the piston rods can be switched off, when the piston rods are not in their regular release position. This prevents for instance that the rotary actuator of the piston rods for unlocking relative to the counterweight is put into operation, when the counterweight is in its position of crane operation. Remains to be noted that the display means are arranged in the form of warning lamps within the visual range of the crane driver, i.e. for instance integrated in the instrument panel of the superstructure cabin.

A further improvement of reliability in service is attained by a crane truck, wherein the locking or unlocking position of the piston rods is detected by means of a third sensor and is recorded by means of a further display. Thereby the crane driver is permanently and completely kept informed about the relevant operational positions of the piston rods.

A further embodiment of the invention relates to a crane truck comprising a fourth sensor, by means of which the desired position of rotation of said superstructure in relation to said undercarriage for lowering said counterweight on said support is detectable, and a third control unit, by means of which a lowering drive of said piston-cylinder drive can be switched off. These further sensors and control units equally serve to increase the reliability in service of the crane truck, for they fundamentally help to prevent a deposit of the counterweight to take place with the superstructure not in the desired rotary position relative to the undercarriage for lowering the counterweight onto the support of the undercarriage. Thereby an extensive reliability in service of the crane truck is achieved with regard to the mounting and the lowering of the counterweight, since any operating errors are excluded and machine disturbances can be detected at any time.

A further embodiment of the invention relates to a crane truck, wherein said proximity switches are arranged laterally spaced away from an outside wall of each of said piston-cylinder drives at positions corresponding to the piston-rod position of operation and of release, respectively, and wherein a slide rod extending in parallel with each of said piston rods and coupled with these in a longitudinally displaceable way and guided for displacement between said proximity switches and the outside cylinder wall, is connected with each of said piston rods, its entry into and exit out of the sensitive region of said proximity switches causing their switch cycle. All the parts specified, i.e. in particular the proximity switches themselves and the slide rods connected with the piston rods, of which the entry into and the exit out of the sensitive region of the proximity switches cause the latter's switch cycle, are freely available outside of the piston-cylinder drive and, consequently, particularly favourable to mounting, servicing and repair. Moreover, the usual construction of the piston-cylinder drives need not be interfered with for the proximity switches. The proximity switches being secured to the piston-cylinder drives for displacement in parallel to the piston rods, simple adjustment of the proximity switches is possible in their positions corresponding to the piston rod positions to be monitored, whereby tolerances within the entire elevating mechanism can be balanced.

A further advantageous embodiment of the invention relates to a crane truck, wherein said third sensor for detection of the locking position and unlocking position of said piston rods staggered one relative to the other by an angle of rotation is formed by in each case two proximity switches arranged on said piston-cylinder drives in a common horizontal plane one referred to the other at an angle of rotation, the switch cycle of said proximity switches is produceable by angle-of-rotation indicators coupled for rotation with the piston rods entering into and exiting out of their sensitive region, and wherein said proximity switches associated with the locking and unlocking position of said two piston rods are connected by twos in series with said third display. Again, the sensor for detecting the locking and unlocking position, respectively, of the piston rods essentially consists of proximity switches, of which the above-described advantages apply here, too. Moreover, the sensor is easy to realize in terms of construction due to the rotary actuator indicated and the latter's being coupled with the piston rod through a drive rod and an angle-of-rotation indicator attached to the latter, in particular there being the possibility of the detection of the angle of rotation of the piston rod arranged outside of the virtual travel of the piston rod at the upper end of the piston-cylinder drive, where sufficient place is available for the sensor.

A further advantageous embodiment of the invention relates to a crane truck, wherein said fourth sensor for detection of the desired position of rotation of said superstructure referred to said undercarriage for depositing said counterweight on said support is formed by a contact switch, which is actuatable by manually placing a plug-in bolt between said undercarriage and said superstructure into the latter's desired position of rotation. The sensor according to this embodiment for detection of the desired position of rotation of the superstructure relative to the undercarriage for lowering of the counterweight onto the support of the undercarriage makes use of the locking between superstructure and undercarriage in this desired position of rotation anyway available in known crane trucks. As a matter of fact, there is nothing else to do but to detect via a contact switch whether a conventional locking bolt is in its place between the undercarriage and the superstructure. This assures that the superstructure is in its desired position of rotation and that actuation of the slewing rim is excluded. Thus the counterweight is automatically placed to take its correct position on the support of the undercarriage. The electric arrangement of the contact switch according to claim 13 ensures that the lowering of the counterweight can only take place when the superstructure has just taken its desired position of rotation. Otherwise the lowering drive is automatically blocked.

Further features, details and advantages of the invention will become apparent from the ensuing description of an exemplary embodiment taken in conjunction with the drawings.

DESCRIPTION OF THE PREFERRED EMBODIMENT

Figure 1:
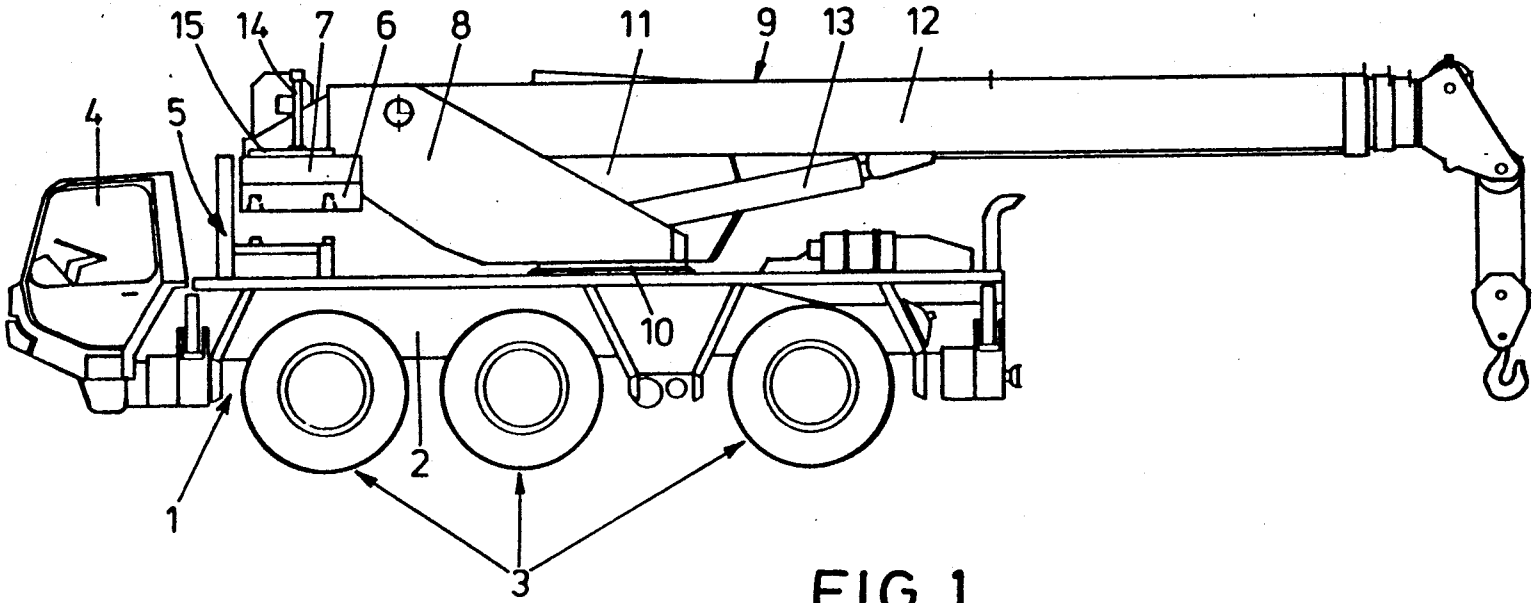
FIGS. 1 and 2, respectively, are lateral views of a crane truck according to the invention in the desired position of rotation of the superstructure referred to the undercarriage for lowering of the counterweight plate, and of its position of driving operation.
Figure 2:
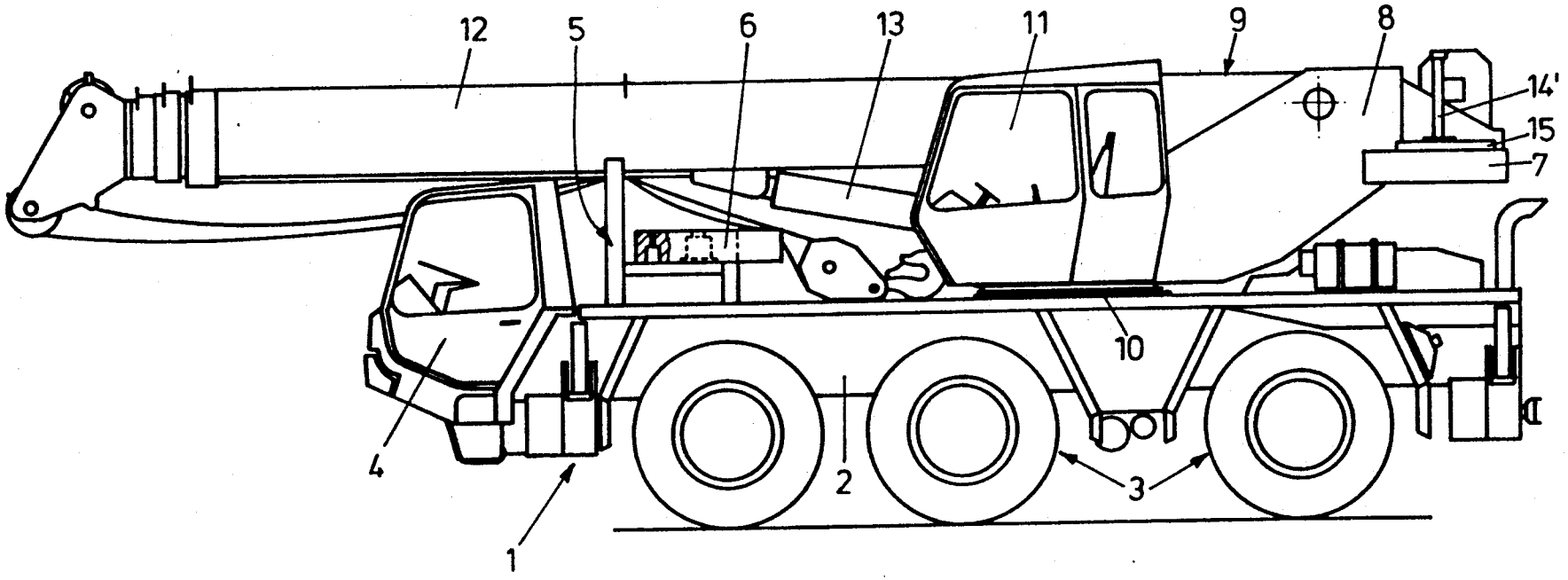
Figure 3:
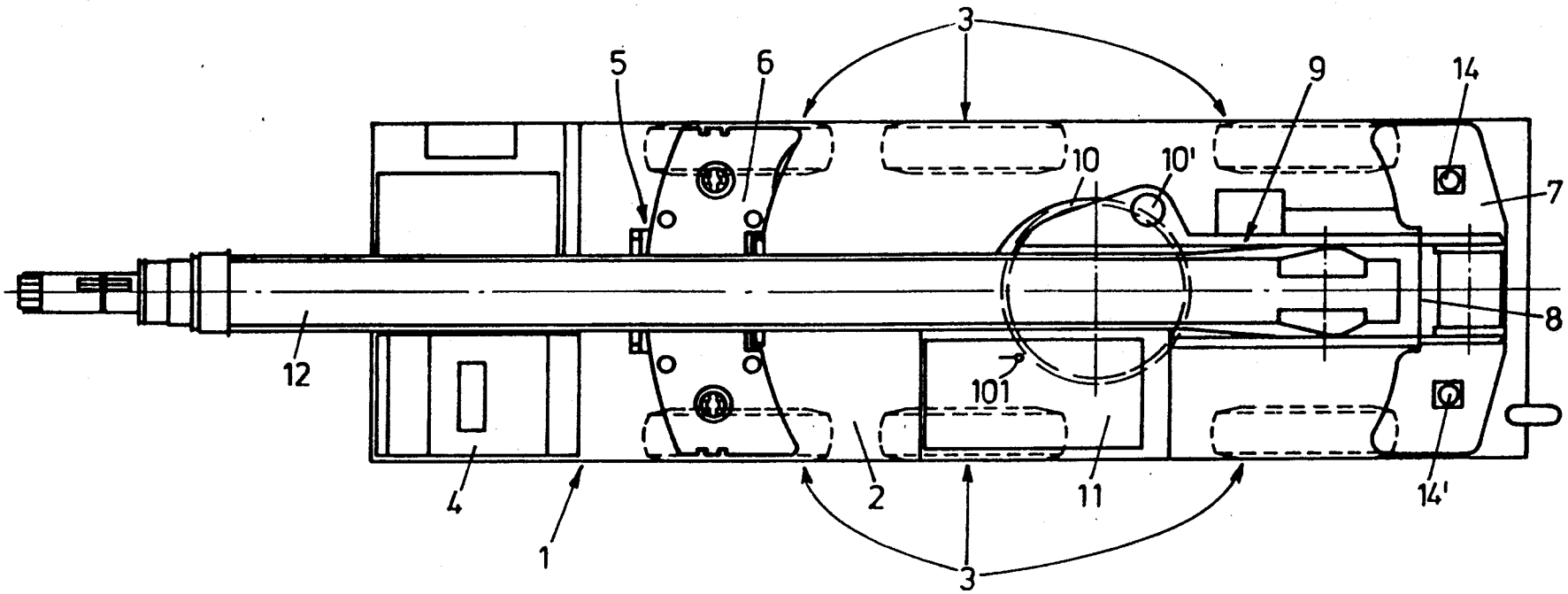
FIG. 3 is a plan view of the crane truck in the position of driving operation of the superstructure, FIGS. 4 and 5, respectively, are lateral views of the rear portion of the counterboom of the superstructure in the position of crane operation of the counterweight and in the latter's position lowered onto the undercarriage.

FIGS. 1 to 3 illustrate a crane truck according to the invention. It has an undercarriage 1 with a chassis 2, a three-axial base frame 3 and a driver's cabin 4. On the top side of the chassis 2 behind the driver's cabin 4 a stage or platform-like support 5 is provided for a counterweight plate 6, which together with a stationary abutment plate 7 of substantially identical shape is retained on the rearward counterboom 8 of the superstructure in its position of crane operation shown in FIG. 1. The superstructure 9 itself is in usual manner supported on the undercarriage for rotation through a slewing rim 10 and has a driver's cabin 11 and a telescopable boom 12, supported on the counterboom 8 to be pivotable in height and movable by way of a so-called boom elevation cylinder 13. The rotary actuator of the superstructure 9 is made by the hydraulic motor 10' on the superstructure 9.

For the counterweight plate 6 to be non-positively retained on the abutment plate 7 in the position of crane operation (FIG. 1) and for its being lowered onto the support 5 (FIGS. 2, 3) an elevating mechanism is provided on the counterboom 8 and consists of two vertical and hydraulic lift cylinders 14, 14' arranged laterally of the boom 12 in the rear portion of the counterboom 8 located behind the point of articulation of the boom 12.

Figure 4:
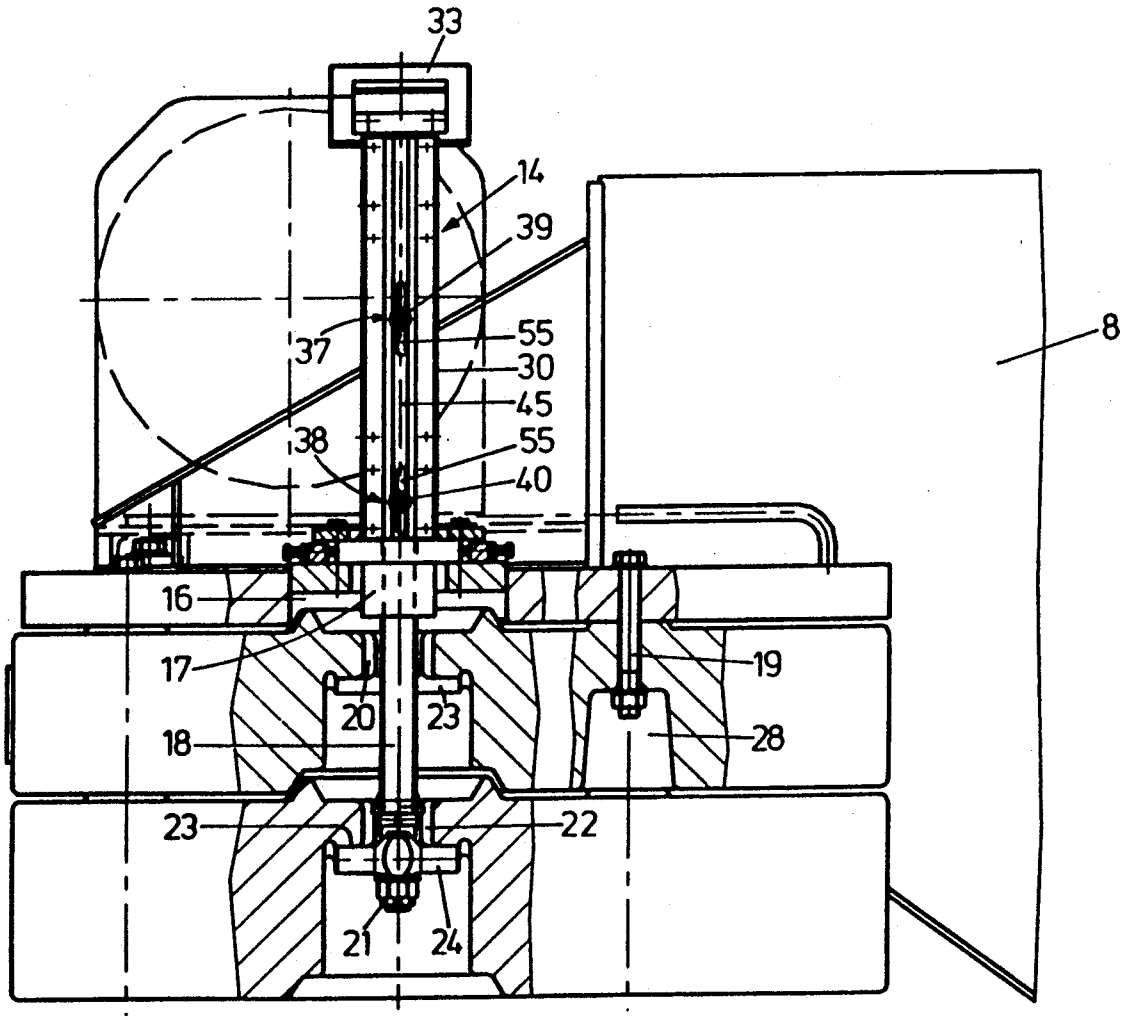
Figure 5:
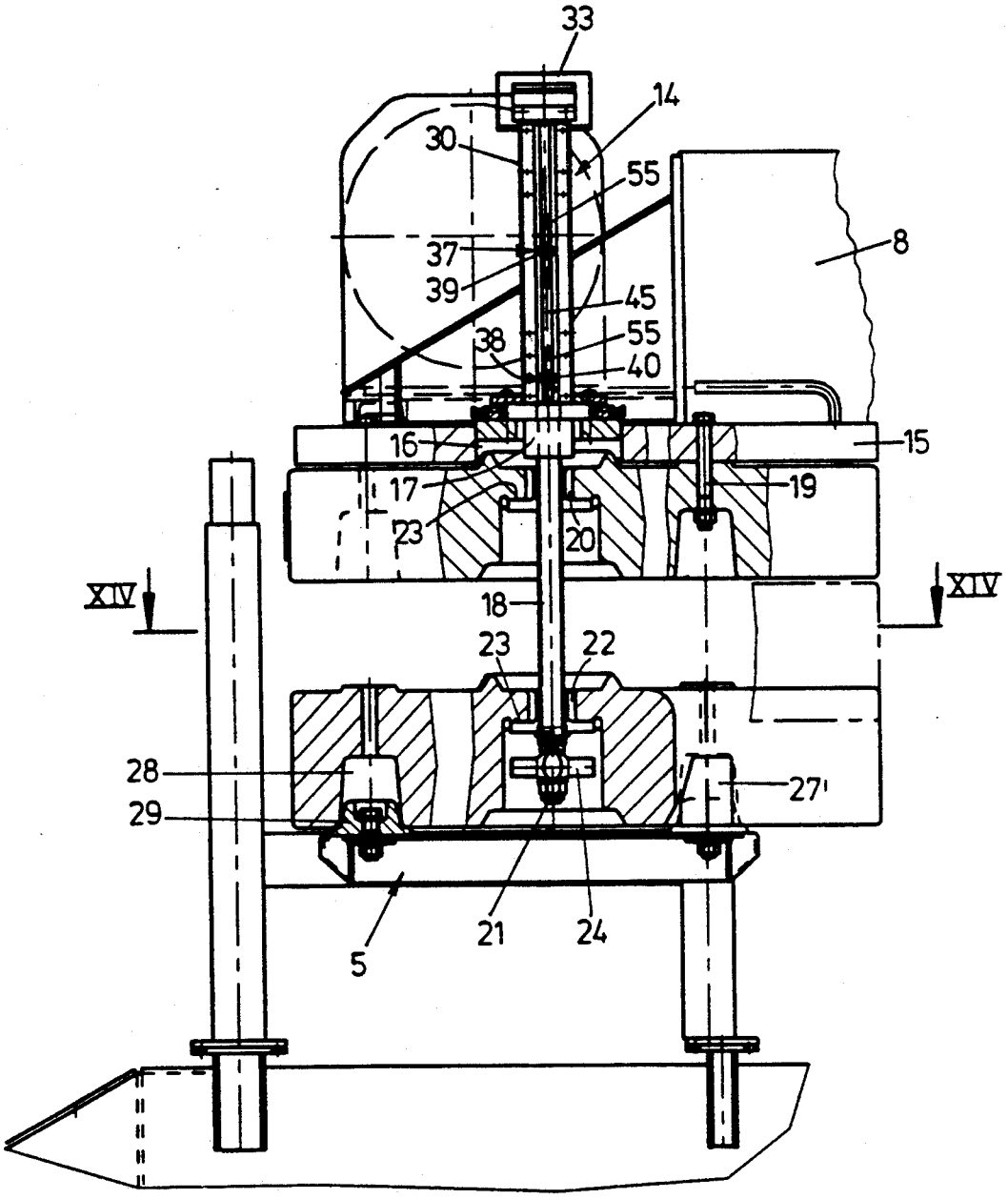
Figure 14:
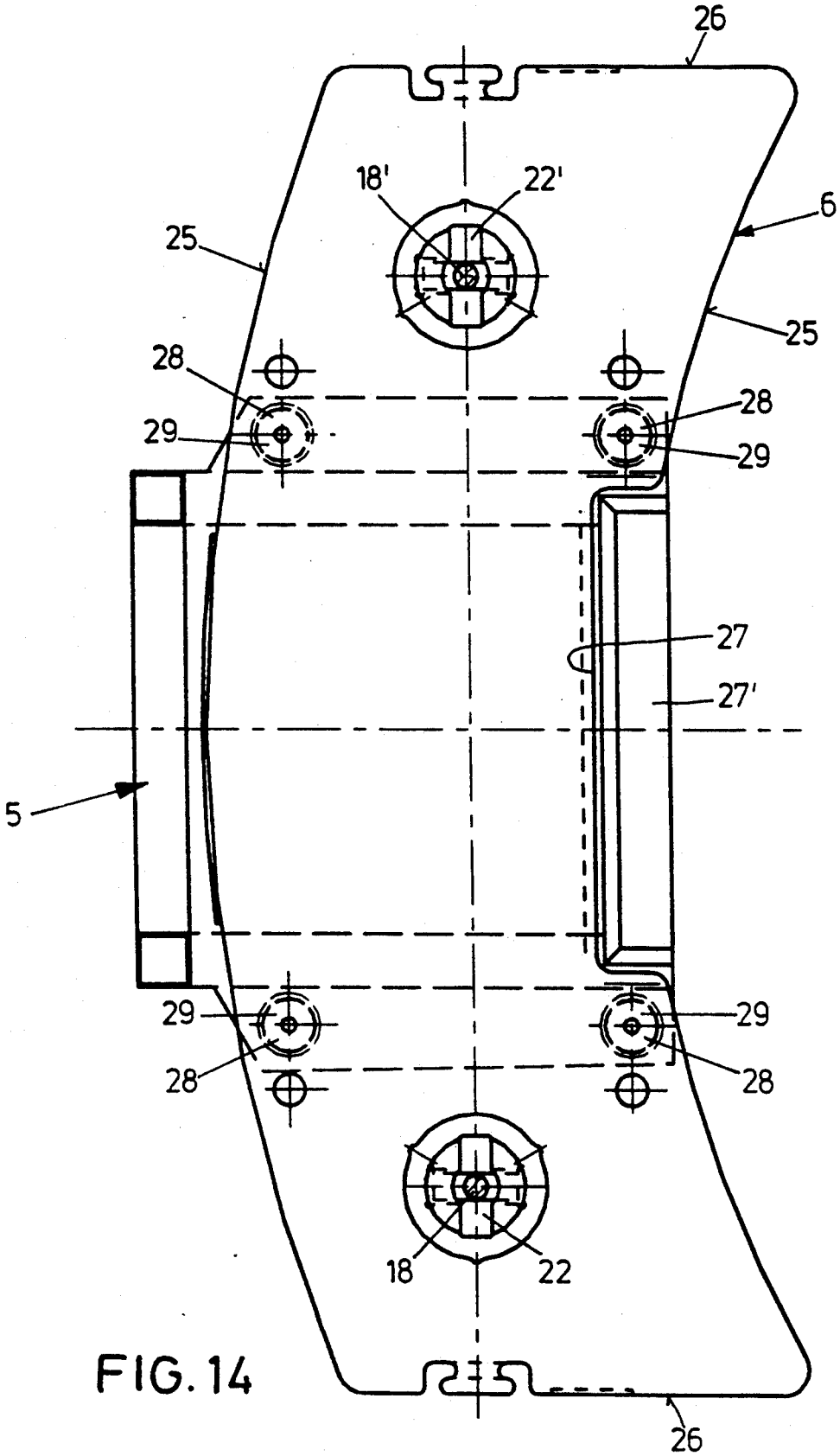
FIG. 14 is a horizontal section through the elevating mechanism along the sectional lines XIV—XIV according to FIG. 5.

As seen in FIGS. 4 and 5, for the mounting of the lift cylinders 14, 14' the counterboom 8 has a horizontally extending plate 15 spreading laterally on both sides of the counterboom 8 and to which the lower retaining blocks 17 of each lift cylinder 14, 14' are secured in openings. Consequently, the lift cylinders 14, 14' project upwards over the plate 15. By way of oblong-hole type passages 20 provided in the abutment plate 7 the piston rods 18, 18' exiting downwards from the lift cylinders 14, 14' pass through the abutment plate 7 tightly connected with the plate 15 by means of screws 19 and their free ends 21 engage with the equally oblong-hole type passages 22, 22' in the counterweight plate 6 (FIG. 14). The passages 20, 22, 22' are cylindrically extended in cross-section from the lower face of the plates 6, 7, so that a step 23 is formed in the vertical extension of the passages 20, 22, 22', which for locking engagement of the counterweight plate 6 (and as the case may be also the abutment plate 7 for the latter's attachment to the superstructure 9) with the piston rods 18, 18' can be gripped from below by the transverse bolts 24, 24' at the free ends 21, 21' of the piston rods. For unlocking of the piston rods 18, 18' they are each to be pivoted by 90° about their longitudinal axis, so that the transverse bolts 24, 24' may freely pass through the oblong-hole type cross-section of the passage 22, 22'. The transverse bolts 24, 24' are supported on the free ends 21, 21' of the piston rods 18, 18' to be pivotable out of the horizontal line by about 5°.

As in particular seen in FIGS. 4, 5, and 14, in a plan view the counterweight plate 6 as well as the abutment plate 7 are of the shape of an arc of a circle with longitudinal sides 25 in the form of a segment of a circle and parallel to one another and straight transverse sides 26 parallel to one another. A flat rectangular recess 27, with which engages an elevation 27' correspondingly formed on the support 5, is provided on the longitudinal side 25 inside the arc. Further, four cup-shaped holes 28 are provided on the bottom side of the plates 6, 7, with which, in the lowered position of the counterweight plate 6 shown in FIG. 5, projections 29 in the shape of a truncated cone of the support 5 engage for reliable positioning of the counterweight plate 6 during operation of the crane truck.

FIGS. 6 to 10 illustrate the structure of the lift cylinder 14. The second lift cylinder 14' is identically formed. Proceeding from the retaining block 17 the cylinder body 30 extends upwards, in which the piston 31 with its piston rod 18 exiting downwards through a sealed pass-through opening 32 is guided to be driven vertically upwards or downwards by means of hydraulic liquid. At the upper end the cylinder body 30 is closed by a cover 33, into which are integrated the rotary actuator 34 and a sensor 35 for detection of the position of rotation of the piston rod 18.

The hydraulic oil connections 36, 56 of the lift cylinder 14 are arranged at the lower and the upper end, respectively, of the cylinder body 30. If hydraulic oil is introduced under pressure through the connection 36 into the lift cylinder 14, the piston 31 with the piston rod 18 moves upwards, whereby oil is pressed out of the cylinder 14 through the upper hydraulic oil connection 56. The procedure is reversed during downwards movement of the piston 31 and the piston rod 18.

Figure 6:
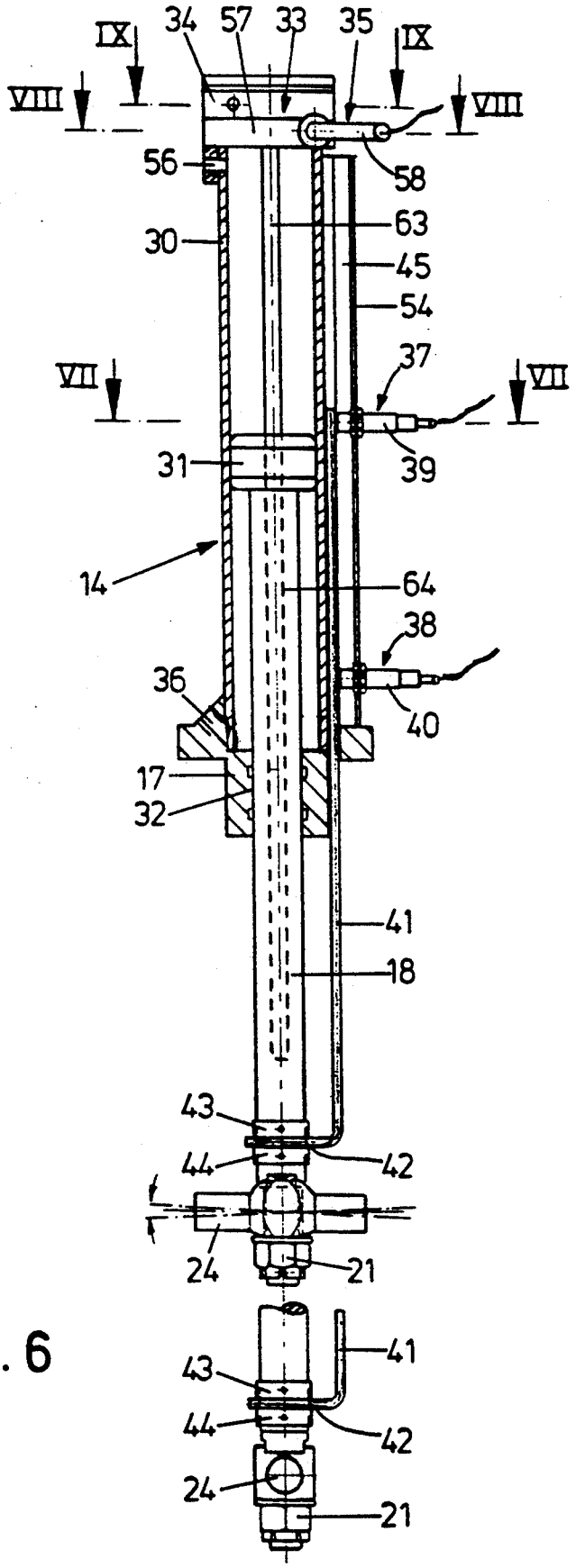
FIG. 6 is a partially sectional lateral view of a lift cylinder of piston-cylinder drive seen in the direction of the arrow VI according to FIG. 4, FIGS. 7 and 8, respectively, are horizontal sections through the lift cylinder along the sectional lines VII—VII and VIII—VIII according to FIG. 6, FIGS. 9 and 10, respectively, are horizontal sections through the rotary actuator for the piston rod in the latter's locking and unlocking position, respectively, according to the sectional line IX—IX according to FIG. 6, FIGS. 11 and 12, respectively, are schematic diagrams of the hydraulic and the electric part of the lift-cylinder control in the locked position of crane operation and in the unlocked release position of the piston rods.
Figure 7:
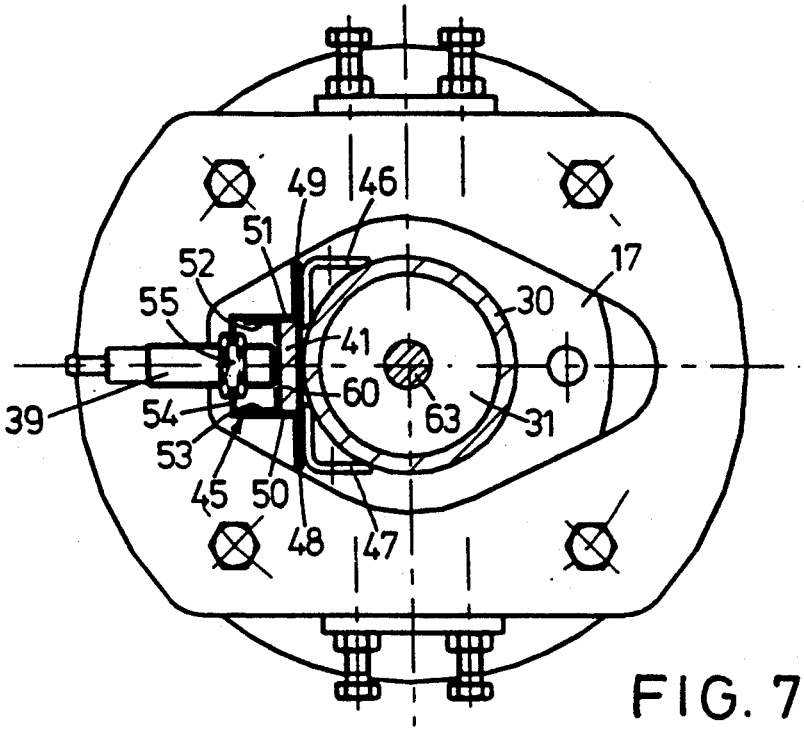

For detection of the vertical position of the piston 31 and thus of the piston rod 18 sensors 37, 38 are provided, which are formed on the outside of the lift cylinder 14 by means of proximity switches 39, 40 in connection with the flat iron slide rod 41 (FIGS. 6, 7). The slide rod 41 extends in parallel to the piston rod 18 and is coupled with the latter for longitudinal displacement, to which effect the lower end of the slide rod 41 is in the form of a fork 42 bent at right angles gripping around the free end 21 of the piston rod 18 between two positioning rings 43, 44 arranged on the piston rod 18 at the top side and the bottom side of the fork 42. Thus the piston rod 18 is freely rotatable in relation to the slide rod 41, but both components are fixed non-displaceably relative to each other in the longitudinal direction.

The mounting of the proximity switches 39, 40 and the guidance of the slide rod 41 takes place via a top hat rail 45 secured to the outside of the cylinder body 30 by way of two angles 46, 47 with its two attachment flanges 48, 49 arranged in the same plane. Two further small angles 52, 53 are secured to the inside of the side legs 50, 51 extending outwards from the attachment flanges 48, 49 and form the outside guidance for the slide rod 41. The proximity switches 39, 40 are secured to the base leg 54 of the top hat rail 45 in longitudinal slits 55 (FIGS. 4, 5) in such a way that between their front ends 60 facing the lift cylinder 14 and forming the sensitive region and the cylinder body 30 sufficient distance remains for the slide rod 41 to be piloted right through the spacing gap.

Due to their attachment in the longitudinal slit 55 the proximity switches 39, 40 are displaceable in parallel to the piston rod 18.

Figure 8:
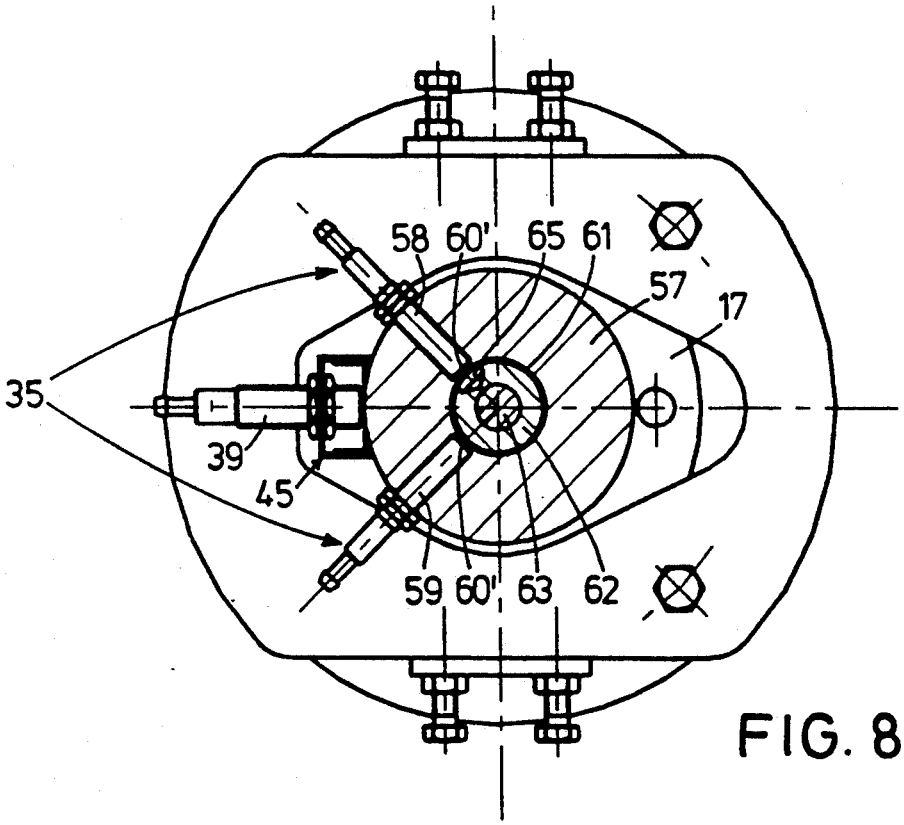

The sensor 35 for detection of the rotary position of the piston rod 18 is illustrated in FIG. 8. Two proximity switches 58, 59 staggered one relative to the other by an angle of rotation of 90° are situated in a thickwalled housing ring 57 and, with their front ends 60' defining the sensitive region, are arranged approximately tangentially referred to a central through-bore 61. As an angle-of-rotation indicator a ring 62 is rotatably supported in the latter and is connected for rotation with a central driving rod 63. The driving rod 63 arranged coaxially with the piston rod 18 in the lift cylinder 14 covers the entire length of the cylinder body 30 and engages with an axial longitudinal bore 64 of the piston rod 18 by force locking referred to the rotation of the two rods 18, 63, whereas coaxial longitudinal displacement of the two rods 18, 63 relative to each other is possible. The recess 65 arranged on the outside of the ring 62 coming into the sensitive region of one of the two proximity switches 58, 59, this will cause one of the latter to respond and thus the position of rotation of the driving rod 63 and also of the piston rod 18 to be detected.

Figure 9:
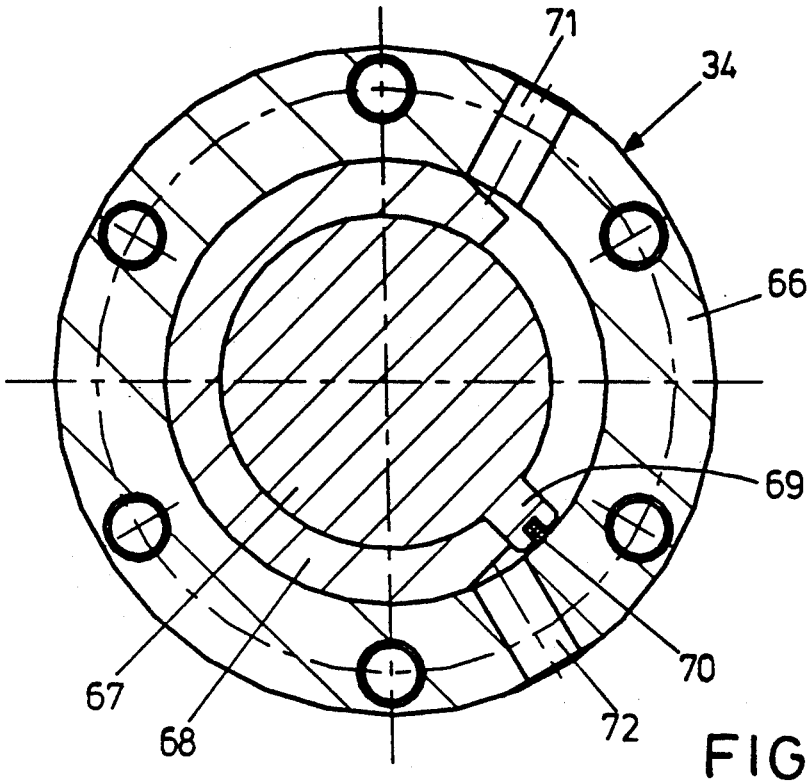
Figure 10:
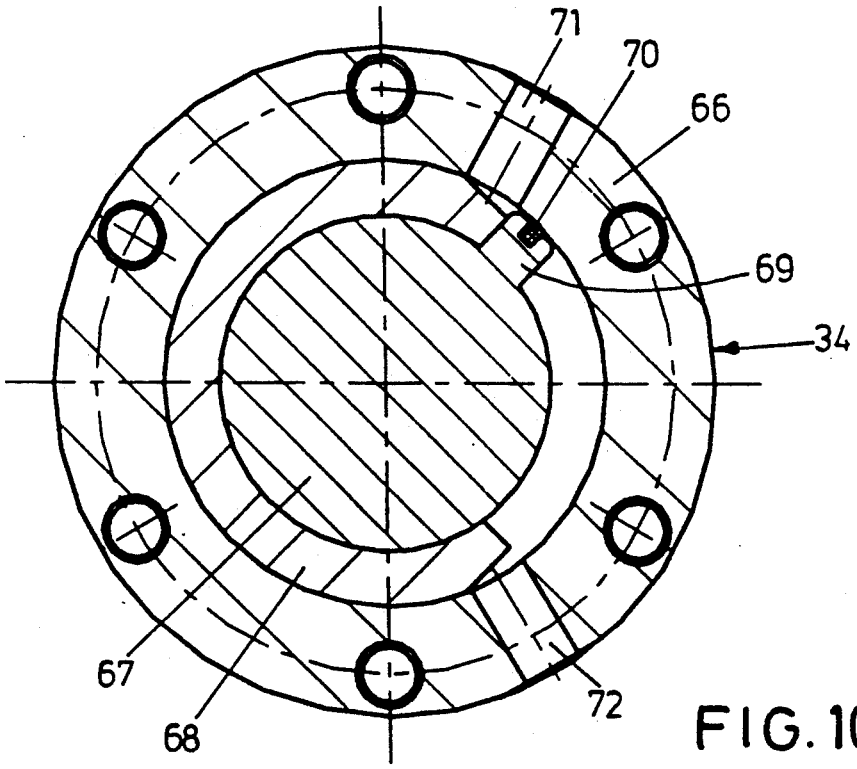

The rotary actuator 34 shown in FIGS. 9 and 10 comprises a cylindrical housing 66, in the internal chamber of which at some distance from the internal walls a disk 67 is coaxially supported to be rotatable, which is tightly connected with the driving rod 63. For about ¾ of the circumference of the disk 67 the spacing gap between the disk 67 and the housing 66 is closed by a stationary partial insert ring 68, of which the free ends serve as a stop for the lateral piston projection 69 of the disk 67. At the free end of the piston projection 69 a sealing 70 is provided closing towards the internal wall of the housing 66. On a level with each of the two free ends of the partial insert ring a housing opening 71, 72 is arranged, through which hydraulic oil is alternately introduced or discharged under pressure. Thus the disk 67 is rotatable between the stop positions shown in FIGS. 9 and 10 by hydraulic control. The movement of rotation is transmitted via the driving rod 63 to the piston rod 18, whereby the latter can be brought into its locking position or unlocking position, respectively, referred to the counterweight plate 6.

Figure 11:
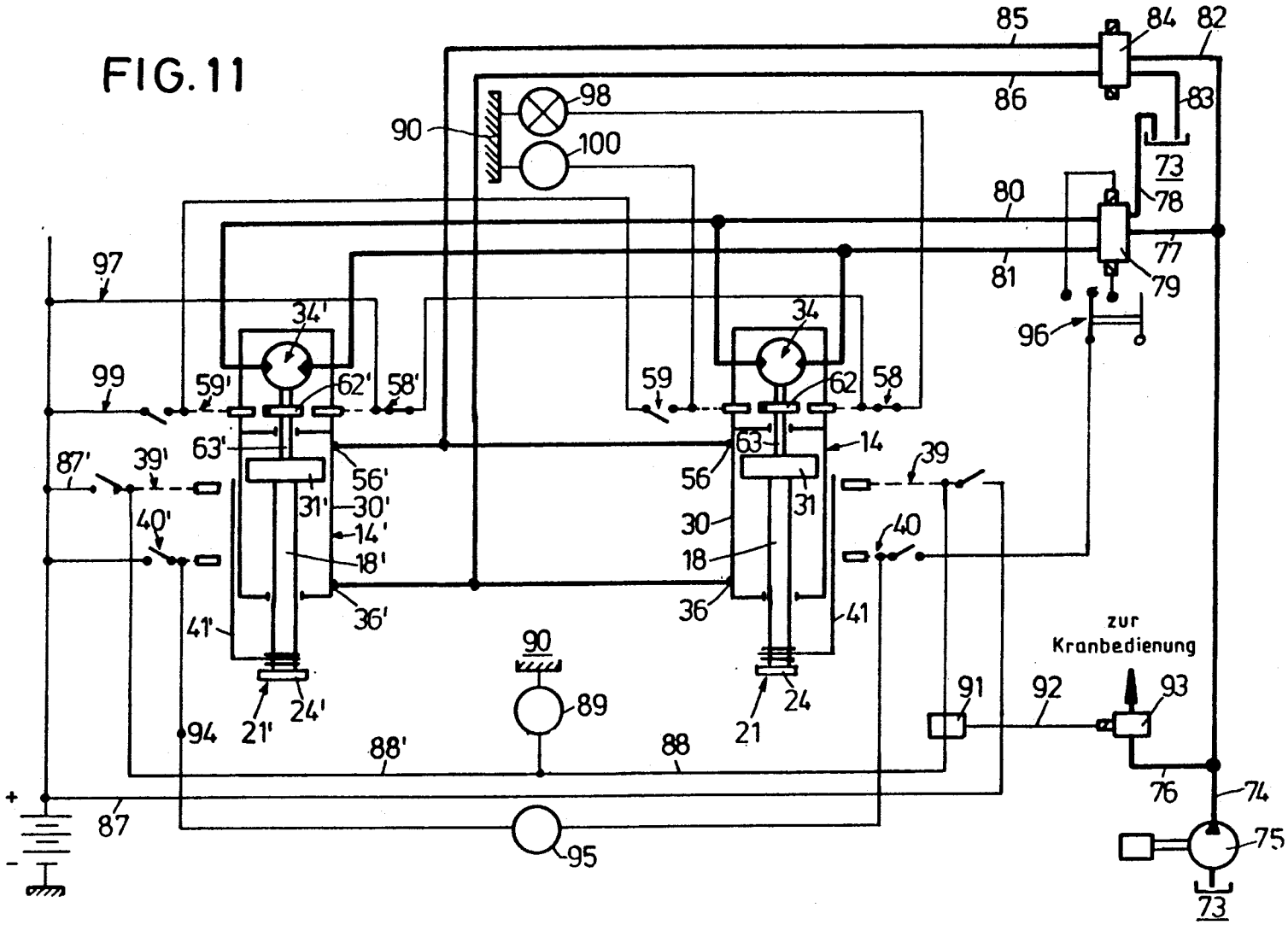
Figure 12:
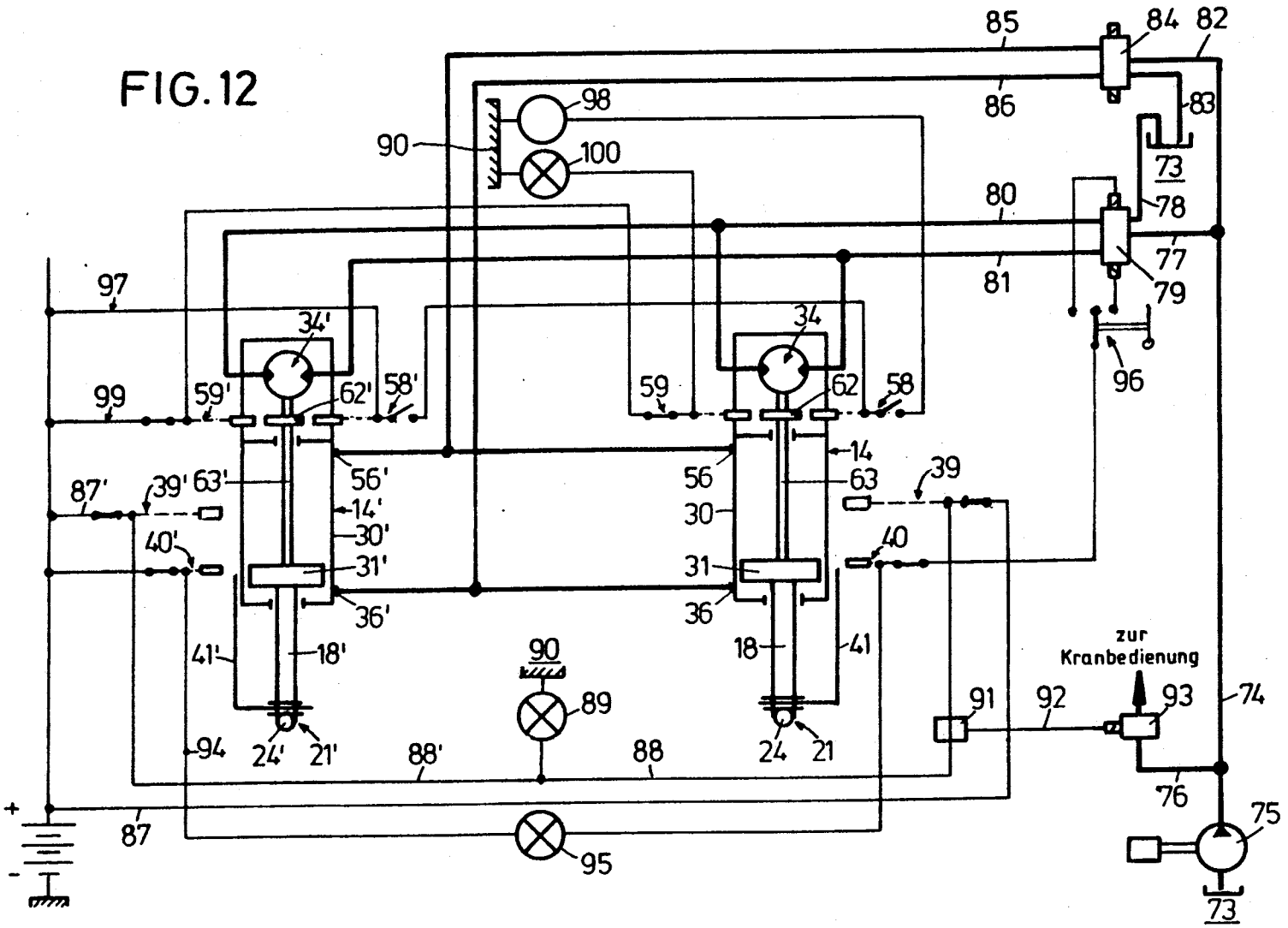

FIGS. 11 and 12 each illustrate a schematic diagram of the hydraulic and electric control and monitoring unit for the elevating mechanism of the counterweight plate 6 in the latter's elevated operation position (FIG. 11) and lowered driving position (FIG. 12), respectively. In both figures the two identically structured lift cylinders 14, 14' are to be found with their associated component parts and annexes. For differentiation of the component parts and annexes of the two lift cylinders 14, 14' their references are with or without an apostrophe in the following as the case may be. Consequently, the piston rods 18, 18', the transverse bolts 24, 24', the cylinder bodies 30, 30', the pistons 31, 31', the rotary actuators 34, 34', the driving rods 63, 63', the angle-of-rotation indicators (rings 62, 62'), the slide rods 41, 41', as well as the various proximity switches 39, 39', 40, 40', 58, 58', 59, 59' are to be seen in FIGS. 11 and 12. The latter are illustrated in FIGS. 11 and 12 as a combination of a flat, small rectangle to outline their constructive position on the lift cylinders 14, 14' and of the electric graphical symbol for "switch" to outline their position in terms of circuit technique within the control units.

Figure 13:
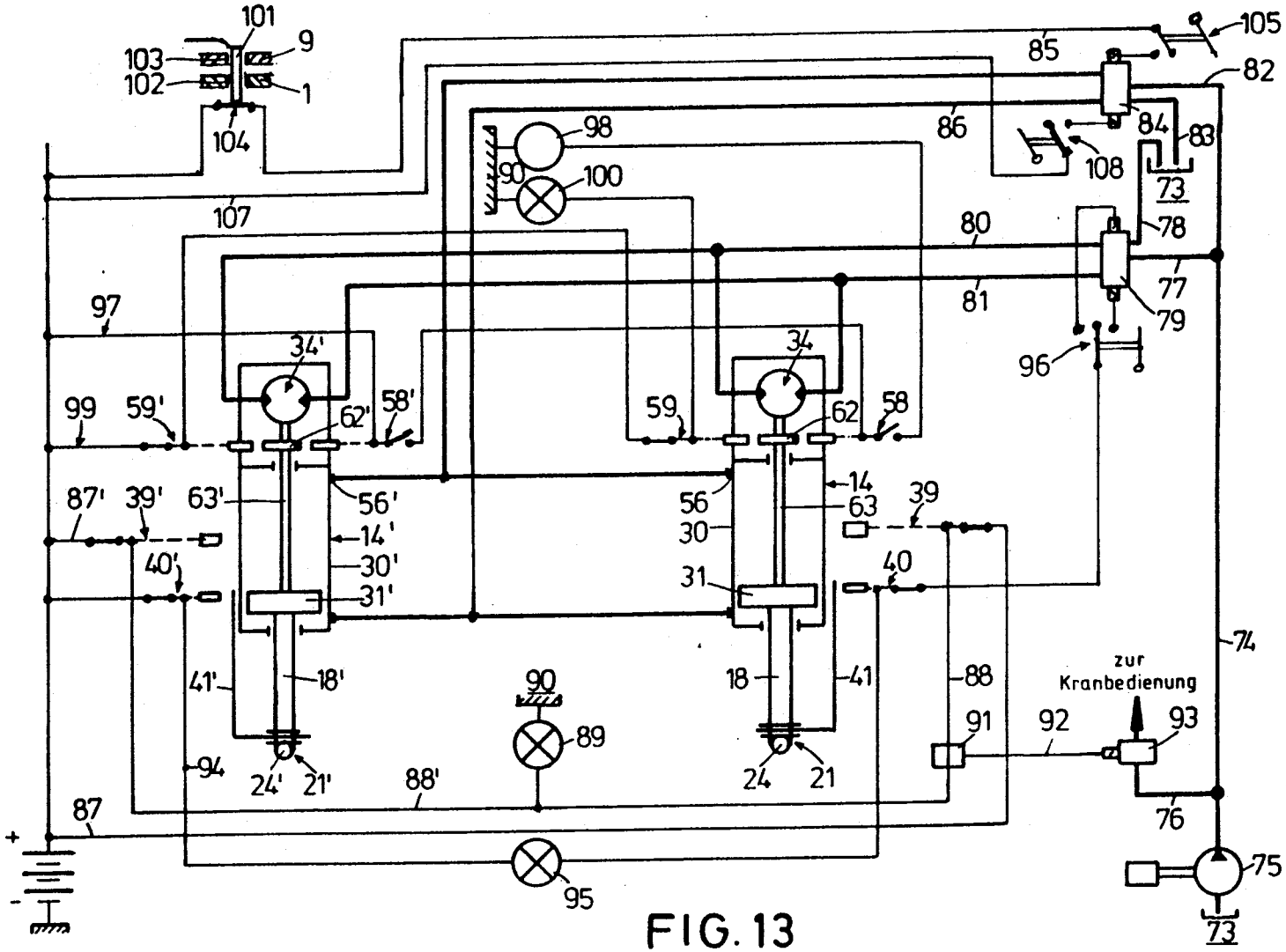
FIG. 13 is a diagrammatic representation of the electric and hydraulic part of the lift-cylinder control in an enlarged embodiment.

The hydraulic part of the control is diagrammatically shown by thicker lines in FIGS. 11 to 13. Proceeding from a hydraulic oil reservoir 73 the pressure line 74 is actuated with hydraulic oil via a hydraulic pump 75. A first branch line 76 leads to the hydraulic elements of the crane operation.

A second line 77 branching from the pressure line 74 as well as a zero-pressure return line 78 to the reservoir 73 are connected via an electromagnetically actuatable two-way valve 79 with the two connection lines 80, 81, which branch each in fluidic parallel connection to the hydraulic connections of the rotary actuators 34, 34'. There being the possibility of alternate connection of the branch line 77 and the return line 78 with the connection lines 80, 81, the latter can function alternately as a pressure-actuated flow line and zero-pressure return line, whereby rotation of the rotary actuators 34, 34' can be caused for locking and unlocking, respectively, of the piston rod 18, 18'.

Via an electromagnetically actuatable two-way valve 84 a third line 82 branching from the pressure line 74 and a further return line 83 to the reservoir 73, alternately, are in connection with the two connection lines 85, 86. The latter branch in fluidic parallel connection to the upper and the lower hydraulic connections of the lift cylinders 14, 14'. Here, too, the connection lines 85, 86 may alternately function as pressure-actuated flow lines and as zero-pressure return lines, respectively, as a result of the alternate connection with the branch line 82 and the return line 83 via the two-way valve 84, whereby driving of the piston rods 18, 18' upwards and downwards in their longitudinal direction is possible.

According to FIGS. 11 and 12 the electric part of the control shown in thinner lines is composed as follows:

Proceeding from the positive operational voltage (+) of the crane truck the two upper proximity switches 39, 39' are electrically connected in parallel via supply lines 87, 87' and discharge lines 88, 88'. These two proximity switches 39, 39' form the first sensor means 37 for monitoring the operation position of the counterweight plate 6 and of the piston rods 18, 18', respectively, shown in FIGS. 4 and 6 (at the top). The warning lamp 89 is connected to ground 90 electrically in series with this parallel connection. A relay 91 is inserted in the discharge line 88 of the proximity switch 39, its control exit being connected via the control line 92 with an electromagnetically actuatable blocking valve 93 in the branch line 76 for crane operation.

In the upper operation position of the counterweight plate 6 and of the piston rods 18, 18', respectively, shown in FIGS. 11 the upper free end of the slide rod 41 is in the sensitive region of the two proximity switches 39, 39', the latter thus being opened. Should one of the two piston rods, for instance the rod 18, move downwards as a result of faulty operation or for instance of leakage in the hydraulic system, the slide rod 41 gets out of the sensitive region of the corresponding proximity switch 39, whereby the circuit between the positive operational voltage (+) is closed via the proximity switch 39 and the warning lamp 89 and the latter is lights up. The crane operator thus receives a corresponding optical warning. Simultaneously the relay 91 responds and closes the blocking valve 93 in the branch line 76 for crane operation, as a result of which no crane movement and in particular no rotation at all of the superstructure 9 by means of the hydraulic motor 10' can be performed anymore.

Starting from the positive operational voltage (+) of the crane truck the lower proximity switches 40, 40' of the two lift cylinders 14, 14' as well as the warning lamp 95 and further a change-over switch 96 are connected in series with the electromagnetically actuatable two-way valve 79 via a connection line referred to as 94 as a whole. The two proximity switches 40, 40' thus form the second sensor 38 and the warning lamp 95 forms a display, by means of which detection and display is possible of the position, in which the piston rods are free, and which is to be taken for release of the locking engagement between the piston rods 18, 18' and the counterweight plate 6 in the latter's deposited position. For, as long as the slide rods 41, 41' of the two lift cylinders 14, 14' are in the sensitive region of the two proximity switches 40, 40', these are opened and the warning lamp 95 does not respond. Further, actuation of the two-way valve 79 and thus triggering of the rotary actuators 34, 34' is impossible. As soon as both piston rods 18, 18' have been moved from the operation position shown in FIG. 11 into the release position shown in FIG. 12 by corresponding pressure actuation of the lift cylinders 14, 14' via the connection lines 85, 86, the slide rods 41, 41' with their upper free end get out of the sensitive region of the proximity switches 40, 40', these close, whereupon the warning lamp 95 responds displaying that the two piston rods 18, 18' have taken their regular position of release. By way of the closed circuit representing the control unit for the rotary actuator control, the two connection lines 80, 81 can be connected with the pressure line 74 and the reservoir 73, respectively, by corresponding actuation of the change-over switch 96 and the resulting triggering of the electromagnetic two-way valve, whereby a rotation of the rotary actuators 34, 34' and thus of the piston rods 18, 18' may take place from their locking position (FIG. 11) into their unlocking position (FIG. 12).

For detection and display of the respective position of rotation of the piston rods 18, 18' the proximity switches 58, 58', 59, 59' are provided in the vicinity of the rotary actuators 34, 34'. To this effect the proximity switches 58, 58' of the two rotary actuators 34, 34' are connected to ground 90 in series with a warning lamp 98 via a connection line referred to as 97 as a whole starting from the positive operational voltage (+) of the crane truck. In parallel therewith and via a corresponding connection line 99 the two other proximity switches 59, 59' are connected in series relative to each other and to the warning lamp 100 between the positive operational voltage (+) and the ground 90. Due to the described construction the two proximity switches 58, 58' are closed in the locking position of the piston rods 18, 18' (FIG. 11) as a result of the ring 62 acting as an angle-of-rotation indicator and the corresponding warning lamp 98 for display of the locking position lights up. If the piston rods 18, 18' have exited downwards into their position of release, which is detected by the proximity switches 40, 40', the rotary actuators 34, 34' can be put into operation by the two-way valve 79 controlled through the change-over switch 96 for rotation of the piston rods 18, 18' from the locking into the unlocking position (FIG. 12). When the locking position has been left, the two proximity switches 58, 58' open and the warning lamp 98 extinguishes. When the locking position is reached, the two proximity switches 59, 59' respond and close, whereby the circuit is closed and the warning lamp 100 lights up. The crane operator may then move the piston rods 18, 18' upwards again by another actuation of the elevating mechanism and turn the superstructure 9 for instance from the position of crane operation shown in FIG. 1 by 180° into the position of driving operation shown in FIG. 2.

The hydraulic and electric control of the counterweight support of FIG. 13 is shown in the unlocked position of release of the piston rods 18, 18' by analogy to FIG. 12. It mostly corresponds to the control shown in FIGS. 11 and 12, so that identical constructional components have the same reference numerals and corresponding description can be dispensed with. It is only distinguished by the below-described additional sensor and control unit for detection of the desired position of rotation of the superstructure 9 referred to the undercarriage 1 to switch off the lowering drive of the lift cylinders 14, 14'.

As outlined in FIGS. 3 and 13, the superstructure 9 of a crane truck with the undercarriage 1 is fixable in the desired position of rotation of the superstructure 9 relative to the undercarriage 1 shown in FIG. 1 for lowering the counterweight plate 6 by means of a plug-in bolt 101 to be plugged into two openings 102, 103 in alignment. To prevent the counterweight plate 6 from being lowered when in a position beyond the desired position of rotation of the superstructure 9 relative to the undercarriage 1 shown in FIG. 1, a contact switch 104 is provided in the plug-in zone of the plug-in bolt 101 as a sensor for detection of this desired position of rotation and is connected in series with an actuating switch 105 between the positive operational voltage (+) and the electromagnetically actuatable two-way valve 84 via a connection line referred to as 106 as a whole. The second control input of the electromagnetic two-way valve 84 is connected with the positive operational voltage (+) via a further connection line 107. The two-way valve 84 is triggered such that by actuation of the actuating switch 105 the lift cylinders 14, 14' are hydraulically acted upon in the sense of a lowering of the piston rods 18, 18'. This is only possible when the plug-in bolt 101 is in its determined position, the contact switch being otherwise opened and current supply of the two-way valve being interrupted. Lifting of the piston rods 18, 18' is possible at any time by actuation of the actuating switch 108.

What is claimed is:

1. A crane truck comprising a drivable undercarriage (1), a superstructure (9) supported on said undercarriage (1) to be rotatable by a slewing rim (10), a counterweight (6) attached to a counterboom (8) of said superstructure (9), which counterboom (8) projects in a direction opposite to the projecting direction of a boom (12) of said superstructure (9), a lifting unit comprising of two vertically arranged and hydraulically actuatable piston-cylinder drives (14, 14') on said counterboom (8), by means of which lifting unit said counterweight (6) is displaceable between a lifted operation position connected with the counterboom (8) and a driving position, in which it rests lowered onto a support (5) on said undercarriage (1), piston rods (18, 18') of said piston-cylinder drives (14, 14') being drivable to rotate about their longitudinal axis between a locking position non-positively connected with said counterweight (6) and an unlocking position of release from said counterweight (6), a first sensor (37) responding to the longitudinal movement of said piston rods (18, 18') of each piston-cylinder drive (14, 14'), by means of which first sensor (37) the piston rod position associated with the operation position of the counterweight (6) is detectable, a first display for displaying the piston rod position, a control unit coupled with at least one of said sensor and said display, by means of which control unit a crane control can be switched off, when said counterweight (6) comes out of its operation position, a second sensor (38) equally responding to the longitudinal movement of said piston rods (18, 18') of each piston-cylinder drive (14, 14'), by means of which second sensor (38) the piston-rod-release position to be taken for release of the locking engagement between said piston rods (18, 18') and said counterweight (6) in their drive position is detectable, a second display for displaying said piston-rod-release position, and a second control unit coupled with at least one of said second sensor and said second display, by means of which a rotary- actuator control (34, 34') of said piston rods (18, 18') can be switched off, when said piston rods (18, 18') are not in their position of release.

2. A crane truck according to claim 1 comprising a third sensor (35), by which the locking and unlocking position of the piston rods (18, 18') is detectable, and a third display, by which the locking and unlocking position of the piston rods (18, 18') is displayable.

3. A crane truck according to claim 2, wherein said third sensor (35) for detection of the locking position and unlocking position of said piston rods (18, 18') staggered one relative to the other by an angle of rotation is formed by in each case two proximity switches (58, 58', 59, 59') arranged on said piston-cylinder drives (14, 14') in a common horizontal plane one referred to the other at an angle of rotation, the switch cycle of said proximity switches (58, 58', 59, 59') is produceable by angle-of-rotation indicators (62, 62') coupled for rotation with the piston rods (18, 18') entering into and exiting out of sensing regions and wherein said proximity switches (58, 58' and 59, 59', respectively) associated with the locking and unlocking position of said two piston rods (18, 18') are connected by twos in series with said third display (98, 100).

4. A crane truck according to claim 3, wherein said angle-of-rotation indicators (62, 62') are in each case located on driving rod (63, 63') connecting a hydraulic rotary actuator (34, 34') arranged at the upper end of each of said piston-cylinder drives (14, 14') with said piston rods (18, 18') non-rotatably, but displaceably in the longitudinal direction one relative to the other.

5. A crane truck according to claim 1 comprising a fourth sensor, by means of which the desired position of rotation of said superstructure (9) in relation to said undercarriage (1) for lowering said counterweight (6) on said support (5) is detectable, and a third control unit, by means of which a lowering drive of said piston-cylinder drive (14, 14') can be switched off.

6. A crane truck according to claim 5, wherein said fourth sensor for detection of the desired position of rotation of said superstructure (9) referred to said undercarriage (1) for depositing said counterweight (6) on said support (5) is formed by a contact switch (104), which is actuatable by manually placing a plug-in bolt (101) between said under-carriage (1) and said superstructure (9) into the latter's desired position of rotation.

7. A crane truck according to claim 6, wherein said contact switch (104) as a control unit for the lowering drive of said piston-cylinder drives (14, 14') is arranged in a supply current circuit (106) for an electromagnetically actuatable two-way valve (84) of a hydraulic lowering and elevating drive of said piston-cylinder drives (14, 14').

8. A crane truck according to claim 1, wherein the first sensor (37) is formed by two proximity switches (39, 39') each associated with one of said piston-cylinder drives (14, 14') and which are electrically connected in parallel to one another and which are in common electrically connected in series with said first display (89).

9. A crane truck according to claim 8, wherein said first control unit comprises a relay (91) arranged in discharge lines (88, 88') between said proximity switches (39, 39') and a blocking valve (93) electrically connected with an output end of the latter in a hydraulic supply line (76) for the crane control.

10. A crane truck according to claim 8, wherein said second sensor (38) is formed by two proximity switches (40, 40') each associated with one of said piston-cylinder drives (14, 14') and electrically arranged in series and which are electrically connected in series with said second display (95) as well as, by way of a change-over switch (96), with an electromagnetically actuatable two-way valve (79) of said hydraulic rotary actuators (34, 34') for the piston rods (18, 18') of the piston-cylinder drives (14, 14'), wherein said proximity switches (39, 39', 40, 40') are arranged laterally spaced away from an outside wall of each of said piston-cylinder drives (14, 14') at positions corresponding to the piston-rod position of operation and of release, respectively, and wherein a slide rod (41, 41') extending in parallel with each of said piston rods (18, 18') and coupled with these in a longitudinally displaceable way and guided for displacement between said proximity switches (39, 39', 40, 40') and the outside cylinder wall, is connected with each of said piston rods (18, 18'), its entry into and exit out of a sensing region of said proximity switches (39, 39', 40, 40') causing switching cycles.

11. A crane truck according to claim 10, wherein the respective connection between said piston rods (18, 18') and said slide rods (41, 41') is in each case formed by a fork (42) of the slide rods (41, 41') having one end bent at right angles and gripping around on outside free end (21, 21') of each of said piston rods (18, 18'), in relation to which fork (42) said piston rods (18, 18') are each arrested freely rotatably, but non-displaceably one relative to the other in the longitudinal direction.

12. A crane truck according to claim 11, wherein said proximity switches (39, 39', 40, 40') are secured to said piston-cylinder drives (14, 14') in each case for displacement in parallel to the piston rods (18, 18').

13. A crane truck according to claim 1, wherein said second sensor (38) is formed by two proximity switches (40, 40') each associated with one of said piston-cylinder drives (14, 14') and electrically arranged in series and which are electrically connected in series with said second display (95) as well as, by way of a change-over switch (96), with an electromagnetically actuatable two-way valve (79) of said hydraulic rotary actuators (34, 34') for the piston rods (18, 18') of the piston-cylinder drives (14, 14').

* * * * *